US009828775B2

(12) United States Patent
Senchuk

(10) Patent No.: US 9,828,775 B2
(45) Date of Patent: Nov. 28, 2017

(54) TOOL FOR REMOVING SNOW FROM A ROOF

(71) Applicant: Earl Senchuk, Marquette, MI (US)

(72) Inventor: Earl Senchuk, Marquette, MI (US)

( * ) Notice: Subject to any disclaimer, the term of this patent is extended or adjusted under 35 U.S.C. 154(b) by 0 days.

(21) Appl. No.: 15/164,561

(22) Filed: May 25, 2016

(65) Prior Publication Data

US 2016/0348374 A1 Dec. 1, 2016

Related U.S. Application Data

(60) Provisional application No. 62/166,174, filed on May 26, 2015.

(51) Int. Cl.
*E04D 13/10* (2006.01)

(52) U.S. Cl.
CPC ..... *E04D 13/106* (2013.01)

(58) Field of Classification Search
CPC ..... E04D 13/106; E01H 5/02; A01B 1/00
See application file for complete search history.

(56) References Cited

U.S. PATENT DOCUMENTS 1,202,791 A * 10/1916 Brownstein ..... E01H 5/02 172/375
3,218,738 A * 11/1965 Bowerman ..... E04D 13/106 294/54.5
3,483,643 A * 12/1969 Erickson ..... E01H 5/02 15/236.01
3,998,486 A * 12/1976 Mittelstadt ..... E04D 13/106 37/284
4,089,127 A * 5/1978 Maijala ..... E04D 13/106 15/236.01
4,103,383 A * 8/1978 Martin ..... E01H 5/02 15/245
4,253,257 A * 3/1981 Albert ..... E01H 5/02 15/257.9
5,083,388 A * 1/1992 Cooley ..... E04D 13/106 37/268
5,524,369 A * 6/1996 Phillips ..... E04D 13/106 294/54.5
5,570,524 A * 11/1996 Groat ..... E04D 13/106 37/268
5,676,413 A * 10/1997 Hauck ..... E04D 13/106 294/54.5
5,943,796 A * 8/1999 Hedstrom ..... E04D 13/0765 294/54.5
6,092,315 A * 7/2000 Katauskas ..... E04D 13/106 15/236.01
6,109,362 A * 8/2000 Simpson, Sr. ..... A01B 1/00 172/375
6,189,942 B1 * 2/2001 Peterson ..... E04D 13/106 294/54.5

(Continued)

*Primary Examiner* — Jamie L McGowan
(74) *Attorney, Agent, or Firm* — Vincent Re PLLC

(57) ABSTRACT

A snow removal device for removing snow from a roof surface includes a multi-angled tool comprising a plurality of panels. The panels include a first panel portion configured to dig into the snow, a second panel portion connected to a trailing edge of the first panel portion, the second panel portion being angled to compact a small amount of snow between the tool and the roof surface, and a third panel portion connected to a trailed edge of the second panel portion, the third panel portion being configured to slide over the compacted small amount of snow.

11 Claims, 6 Drawing Sheets

(56) References Cited

U.S. PATENT DOCUMENTS

| | | | | |
|---|---|---|---|---|
| 6,202,329 | B1 * | 3/2001 | Supplee | E04D 13/106 294/54.5 |
| 6,338,210 | B1 * | 1/2002 | Mele | E04D 13/106 294/54.5 |
| 6,578,890 | B1 * | 6/2003 | Gilmore | E04D 13/106 294/53.5 |
| 7,762,597 | B2 * | 7/2010 | Marlin | E01H 5/02 294/54.5 |
| 8,100,447 | B2 * | 1/2012 | Dewinter | A01B 1/02 294/51 |
| 8,256,809 | B2 * | 9/2012 | Coutu | A01B 1/20 294/49 |
| 8,347,528 | B1 * | 1/2013 | Seltzer | E01H 5/02 172/371 |
| 2004/0055184 | A1 * | 3/2004 | Peterson | E04D 13/106 37/230 |
| 2013/0111785 | A1 * | 5/2013 | Fehr | E04D 13/106 37/197 |
| 2013/0167411 | A1 * | 7/2013 | Bjorthun | E01H 5/02 37/197 |

* cited by examiner

TOOL FOR REMOVING SNOW FROM A ROOF

CROSS REFERENCE TO RELATED APPLICATIONS

This disclosure claims the benefit of U.S. Provisional Application No. 62/166,174 filed on May 26, 2015 which is hereby incorporated by reference.

TECHNICAL FIELD

This disclosure is related to a device for clearing snow from a roof, particularly to a device with a blade configured to glide closely above roof shingles while dislodging and channeling away a majority of snow from the roof surface.

BACKGROUND

The statements in this section merely provide background information related to the present disclosure. Accordingly, such statements are not intended to constitute an admission of prior art.

Heavy snow accumulating upon a roof can damage the roof through the weight of the snow. Melting and refreezing snow upon a roof can cause "ice dams" which can damage the roof and cause the roof to leak. Accumulated snow on a roof can fall upon a person standing under the roof A person can stand on a roof with a shovel and use the shovel to remove snow. This can be a dangerous and labor intensive process. Long handled tools can be used to sweep or pull snow from a roof. However, known tools frequently include complicated mechanisms that stand out at sharp angles away from the tool handle, frequently creating easily broken tools. Other tools include heavy device that are difficult for an average person to wield or include wheels that roll upon the shingles of the roof, potentially damaging the shingles.

SUMMARY

A snow removal device is disclosed for removing snow from a roof surface. The device includes a multi-angled tool comprising a plurality of panels. The panels include a first panel portion configured to dig into the snow, a second panel portion connected to a trailing edge of the first panel portion, the second panel portion being angled to compact a small amount of snow between the tool and the roof surface, and a third panel portion connected to a trailed edge of the second panel portion, the third panel portion being configured to slide over the compacted small amount of snow.

BRIEF DESCRIPTION OF THE DRAWINGS

One or more embodiments will now be described, by way of example, with reference to the accompanying drawings, in which.

DETAILED DESCRIPTION

Figure 1:
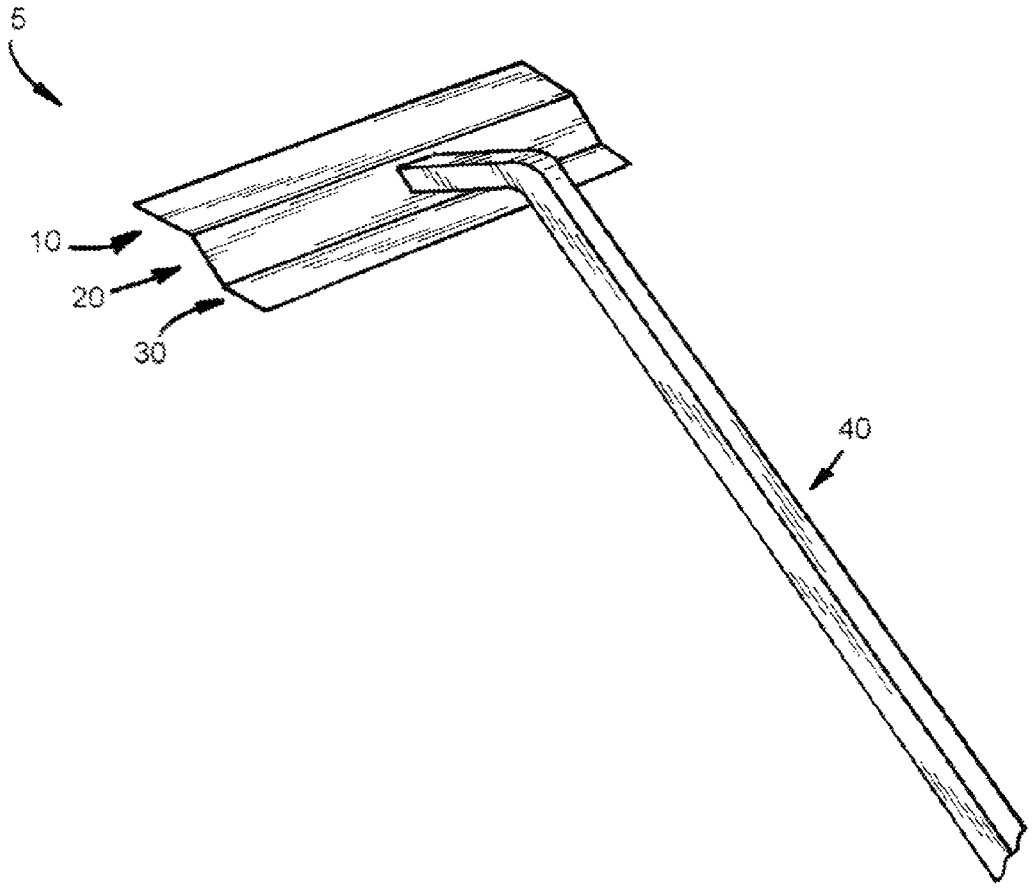
FIG. 1 illustrates an exemplary snow removal device including a tool handle connected to a tool with a multi-angled blade configured to remove snow from a roof, in accordance with the present disclosure.

Referring now to the drawings, wherein the showings are for the purpose of illustrating certain exemplary embodiments only and not for the purpose of limiting the same, FIG. 1 illustrates an exemplary snow removal device including a tool handle connected to a tool with a multi-angled blade configured to remove snow from a roof. Snow removal device 5 is illustrated, including tool panel portions 10, 20, and 30 configured to dig into snow accumulated upon a roof and cause the snow to dislodge and fall from the roof. Panel portions 10, 20, and 30 are illustrates as three connected planar sheets. The tool blade can be constructed of any known material such as exemplary plastic or aluminum which can be used to construct a typical snow shovel blade known in the art. In place of flat planar sheets, portions 10, 20, and 30 can include curved transitions between the portions, so long as blade surfaces impact the snow in a same manner as disclosed herein.

The illustrated handle 40 can take a number of different forms. For example, one or a number of square or circular cross section poles can be used to construct the handle. In one embodiment, a user may add to the pole in exemplary five foot sections to make the pole as long as is necessary. In one embodiment the handle can include one circular section pole inserted within another larger circular section pole, with a twist lock mechanism allowing the user to select the overall length of the pole by pulling one pole partially out of the other pole and using the twist lock mechanism to fix the poles together. In a similar embodiment, the outer pole can have a constriction band at the interface with the inner pole, and a fastener on the constriction band can be used to tighten and thereby fasten the band to the inner pole, thereby locking the poles together in an overall desired length. The blade tool affixed to the end of the tool handle is configured to be thrust into a snow pack upon a roof to dislodge snow from the snow pack.

Figure 2:
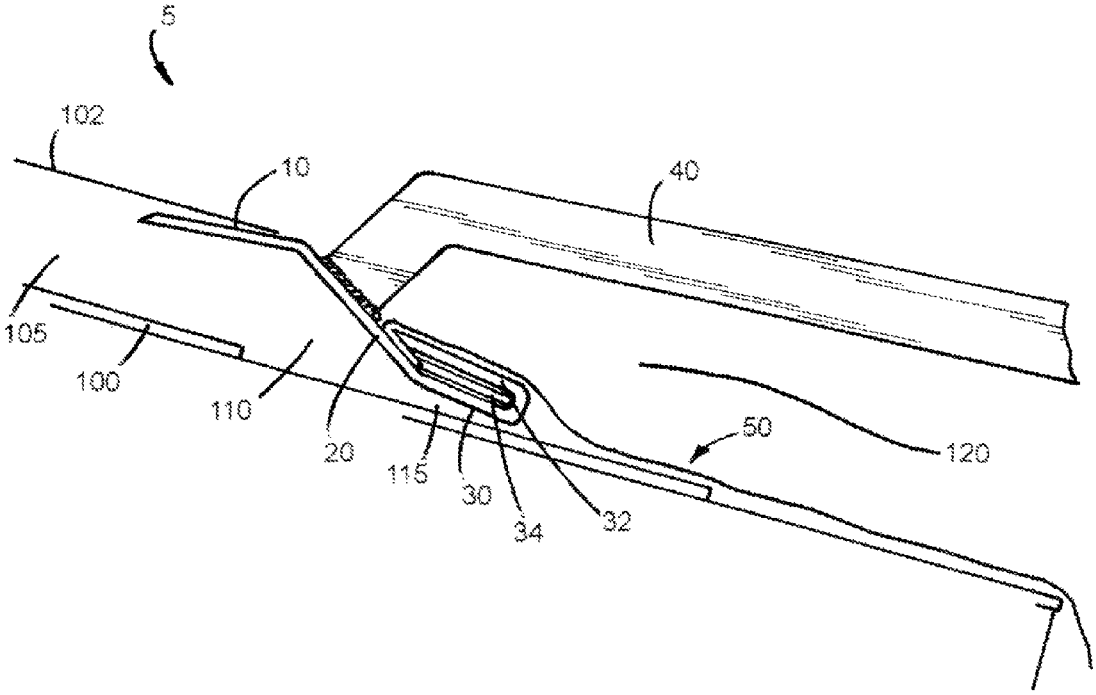
FIG. 2 illustrates the multi-angled blade of FIG. 1 including attachment of a plastic sheet to the tool in the context of a roof surface, in accordance with the present disclosure.

FIG. 2 illustrates the multi-angled blade of FIG. 1 including attachment of a plastic sheet to the tool in the context of a roof surface. Snow removal device 5 is illustrated, including tool portions 10, 20, and 30 configured to dig into snow accumulated upon a roof and cause the snow to dislodge and fall from the roof. Portions 10, 20, and 30 are illustrates as three connected planar sheets. Roof surface 100 is illustrated, including a flat, slightly stepped surface provide by layers of overlapping roof shingles known in the art. Handle 40 is provided whereby a user may provide a thrusting force parallel or nearly parallel to roof surface 100. Parallel line 102 is provided for illustration purposes only, showing what angle a blade on device 5 would need to be to be parallel with a surface of the roof. Portion 10 is illustrated canted or angled slightly downward in relation to parallel line 102. As device 5 is thrust into a bank of snow in region 105, the downward angle of portion 10 would tend to cause the blade to be pushed against roof surface 100. This downward force created by portion 10 ensures that device 5 stays closely against roof surface 100. Parallel line 102 is an imaginary construction useful to describe how the tool panel portions move over a roof surface. However, handle 40 will typically be used in a parallel or almost parallel relation to the roof surface. As a result, the tool planar portions and their angles in relation to line 102 can be similarly described in relation to handle 40, with portion 10 being slightly angled toward the roof surface in relation to the handle, with portion 30 being either flat or slightly angled away from the roof surface in relation to the handle, and with portion 20 being angled away from the roof surface more than portion 30.

As portion 10 is thrust into snow, some snow will go under portion 10 into region 110. This snow in region 110 will come into contact with portion 20 which is slanted upwards in relation to parallel line 102. As snow comes into contact with portion 20, it is compressed against roof surface 100. Finally, the compressed snow of region 110 enters region 115 below portion 30. Portion 30 can be flat or slightly angled upward in relation to parallel line 102. Portion 30 rides upon a layer of compressed snow in region 115, such that the device 5 does not or infrequently contacts the roof surface 100.

Snow passing over portion 10 is broken up by the force of gravity and the impact of device 5, and falls over the device into region 120 where the broken up snow can fall down the angled incline of the roof surface.

The blade tool of the illustrated device is illustrated suspended over a roof surface including layer shingles common to modern housing. In the illustrated embodiment, the tool has three distinct angled sections. The first, portion 10, includes a substantially planar surface that is thrust edge first into the snow bank on the roof. In one embodiment, the planar surface can be parallel to the handle of the device. In the illustrated embodiment, the portion 10 includes a slight angle greater than zero with respect to the handle, in the direction of the roof surface. In most cases, the handle will be operated substantially parallel to the roof surface. In such use, portion 10 will dig into the snow bank at a slight angle toward the roof surface, thereby tending to keep the tool close to the roof surface and not drift away from the roof surface. Further, the weight of the snow above the tool acting on portion 10 will further keep the tool close to the roof. Such a drifting away would cause the tool to leave behind a large amount of snow on the roof. Portion 20 is angled, such that snow being pushed upon by portion 20 is pressed down upon the roof or compacted, leaving a small amount of snow upon the roof under the tool. This compacted amount of snow prevents the tool from touching the shingles of the roof, thereby preventing damage to the roof. Finally portion 30 acts as a bearing surface, riding upon the compacted amount of snow on the roof. In this way, the blade tool can be thrust into a snow bank, dislodge and break up the snow, and remain close to the roof while not touching the roof.

An optional plastic sheet 50 is shown attached to the blade tool. This plastic sheet receives dislodged snow falling over the tool in region 120. The surface of the plastic sheet is smooth, and the chunks of snow that fall upon it tend to continue to fall along the sheet until they fall off the edge of the roof. In this way, snow can easily be removed from the roof surface.

The blade tool of FIG. 2 can be lightweight and made of resilient material. In one example, the blade can be made of thin-gage steel. In another embodiment, the blade can be made of light weight aluminum. Any similar metallic material or alloy can be used. In another embodiment, the blade can be made of a resilient polymer or plastic material. Any width blade can be used. A larger blade, for example, 24 to 36 inches in width, can be made available for physically fit individuals that have the strength to use a larger tool. A smaller blade, for example, 12 to 24 inches in width, can be made available for less fit or elderly individuals. In one embodiment, the blade tool can be extruded. In another embodiment, the tool can be made from sheet metal in a stamping and bending process. In another embodiment, the tool can be injection molded.

Plastic sheet 50 can be attached to device 5 in a number of different ways. The device of FIG. 2 illustrates a wrap around section 32 of portion 30, wherein a long thin rod 34 can be slid within wrap around section 32. By wrapping an end of sheet 50 around rod 34, sheet 50 can be removably attached to device 5. Sheet 50, if removable, can be provided in a number of different lengths, widths, or thicknesses. If sheet 50 becomes damaged, it can be replaced. If sheet 50 becomes stuck, for example, upon a gutter cap system meant to keep leaves out of the gutter, sheet 50 can be disconnected from device 5.

Figure 3:
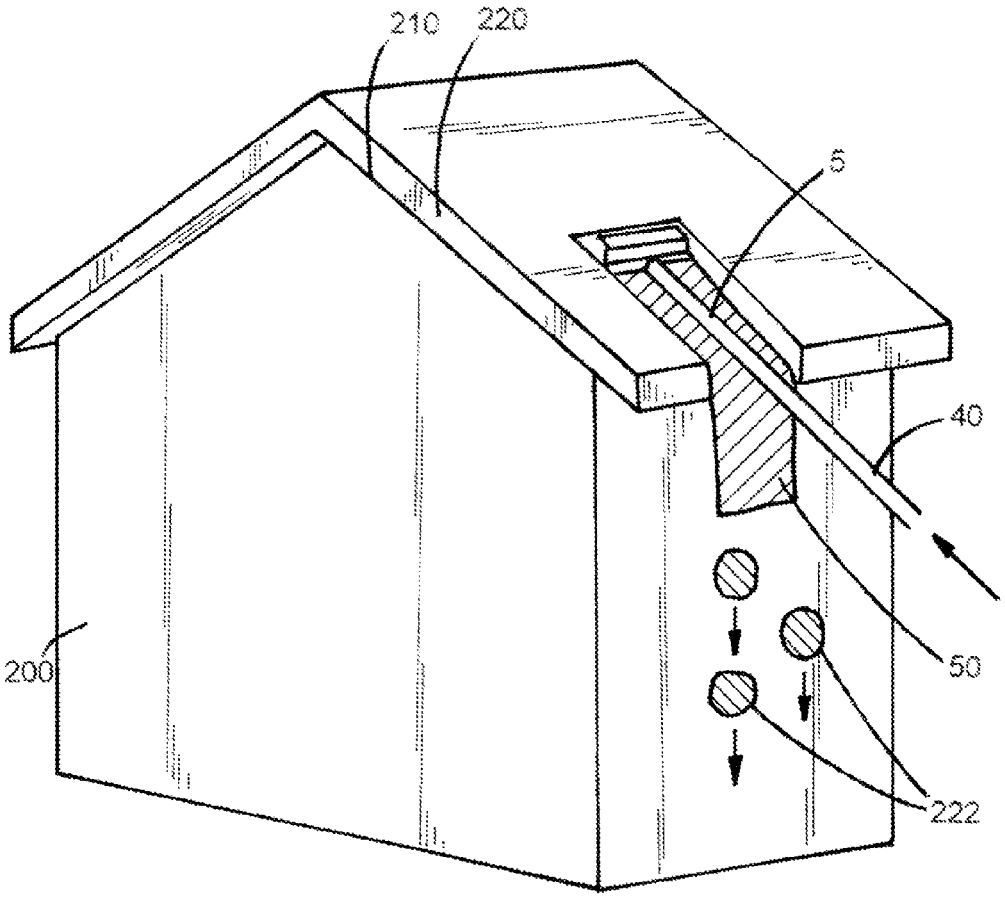
FIG. 3 illustrates the tool of FIG. 2 including the plastic sheet being used to remove snow from a roof, in accordance with the present disclosure.

FIG. 3 illustrates the tool of FIG. 2 including the plastic sheet being used to remove snow from a roof. Structure 200 is illustrated including roof surface 210 covered with snow 220. Device 5 including handle 40 is illustrated being pushed up roof surface 210. Plastic sheet 50 is attached to device 5. As snow 220 is impacted with device 5, snow chunks 220 fall down sheet 50 and off of roof surface 210.

The plastic sheet can typically be the same or similar width to the tool. In one embodiment, the plastic sheet should be long enough that the individual can reach the apex of the roof and still have the plastic sheet at least to the edge of the roof overhang, so snow can travel down the plastic sheet and over the edge without getting hung up on the shingles.

Figure 4:
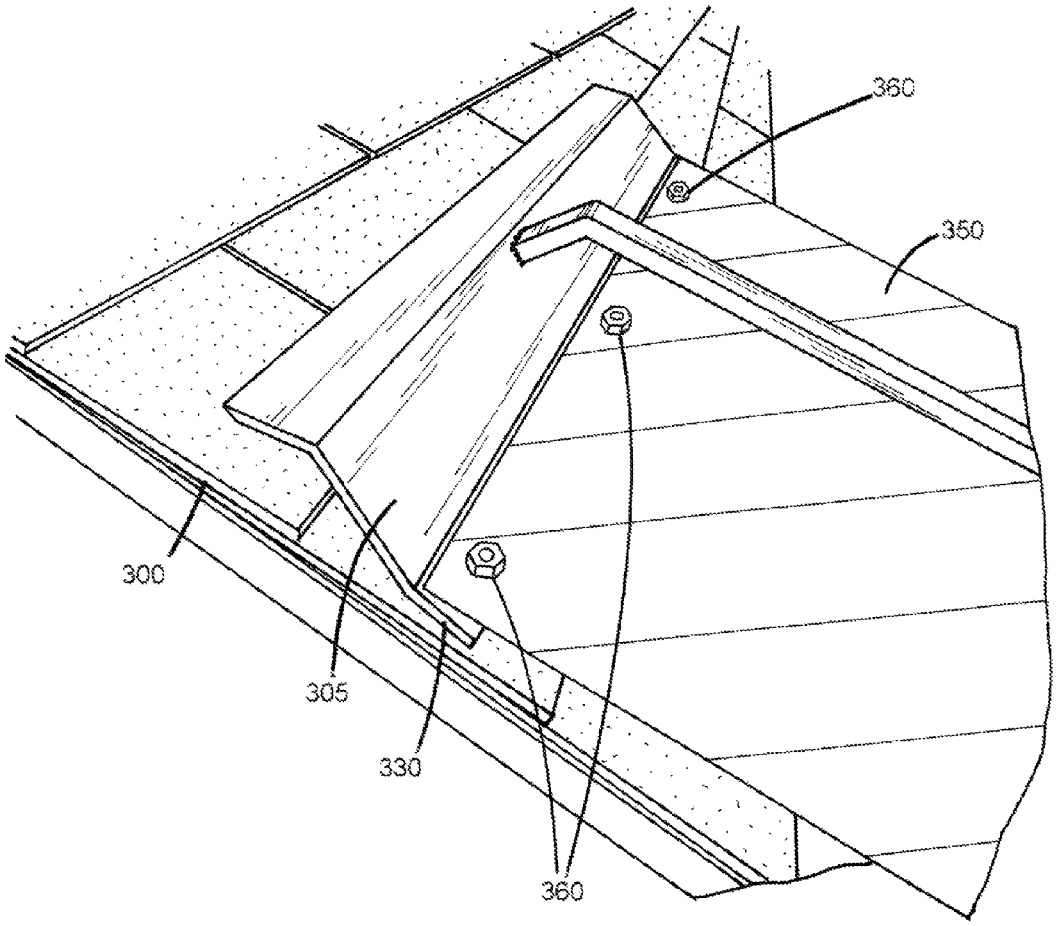
FIG. 4 illustrates the tool of FIG. 2 from a different angle and including details of the attachment of the plastic sheet to the tool, in accordance with the present disclosure.

FIG. 4 illustrates the tool of FIG. 2 from a different angle and including alternative details of the attachment of the plastic sheet to the tool. Device 305 is illustrated including angular planar portions consistent with portion 10, 20, and 30 of device 5. Device 305 is illustrated in relation to typical roof surface 300. Portion 330 is illustrated as a planar portion through which a number of holes are provided and configured to accept fasteners 360 for the attachment of sheet 350 to device 305. Fasteners 360 can include countersunk heads upon a bottom side of device 305 to provide a flat surface upon the bottom of portion 330. Sheet 350 can include metal eyelets or reinforcement rings to strengthen the sheet at the points of contact with fasteners 360.

Figure 5A:
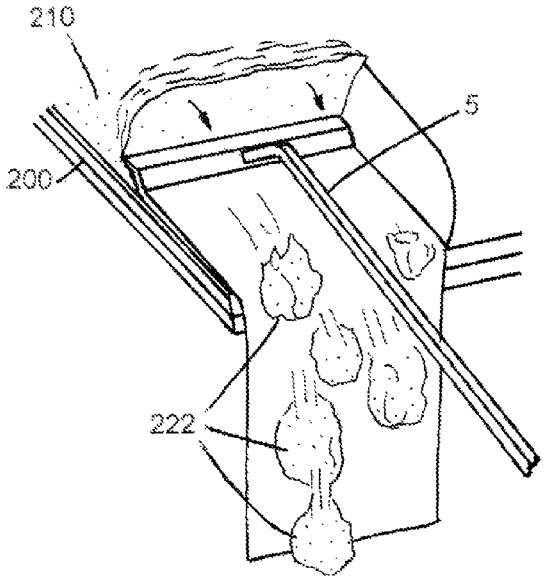
FIGS. 5A and 5B illustrate the tool of FIG. 3 removing snow from the roof surface of FIG. 3 in detail, and, in particular, illustrating a mass of packed snow being broken up and channeled away by the tool, in accordance with the present disclosure.
Figure 5B:
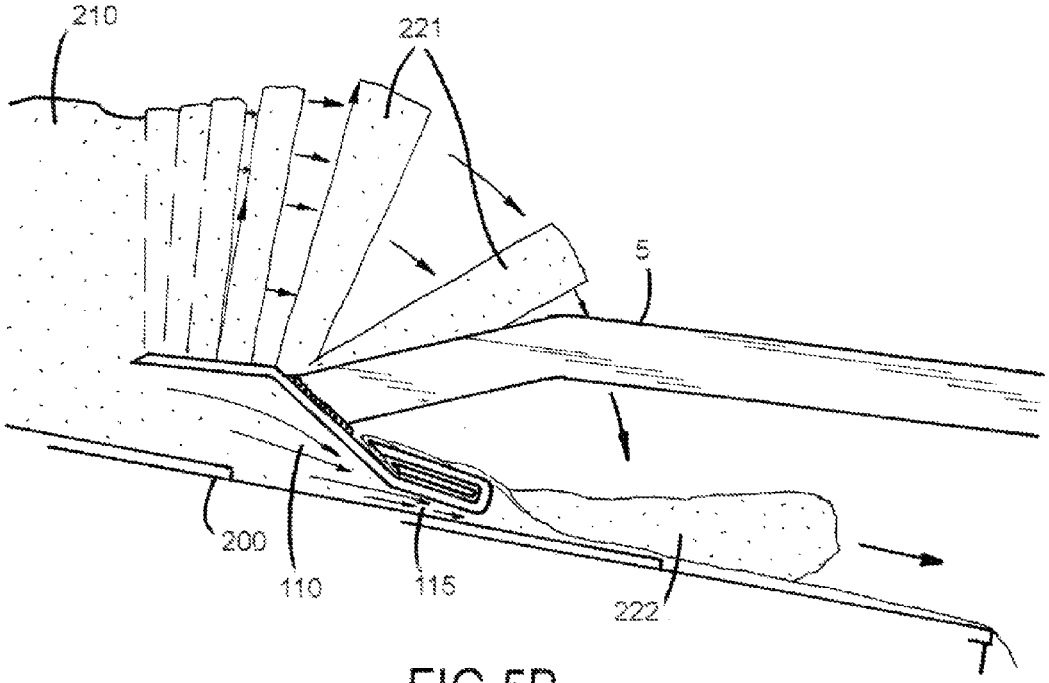

FIGS. 5A and 5B illustrate the tool of FIG. 3 removing snow from the roof surface of FIG. 3 in detail, and, in particular, illustrating a mass of packed snow being broken up and channeled away by the tool. FIG. 5A illustrates device 5 in perspective view as the device digs into a mass of snow 210 upon roof surface 200. Chunks of snow 222 are illustrated falling off the roof after being dislodged by device 5. FIG. 5B illustrates the device of FIG. 5A in profile as it digs into the mass of snow. Roof surface 200 is illustrated including mass of snow 210 upon the roof surface. Device 5 is illustrated creating dislodged blocks 221 of snow from snow 210, which fall upon either the roof surface 200 or a plastic sheet attached to device 5 and become chunks of snow 222 falling from the roof surface. As device 5 digs into snow 210, some of the snow enters into region 110 under device 5 and is compressed into a flat mass of compressed snow in region 115.

Figure 6:
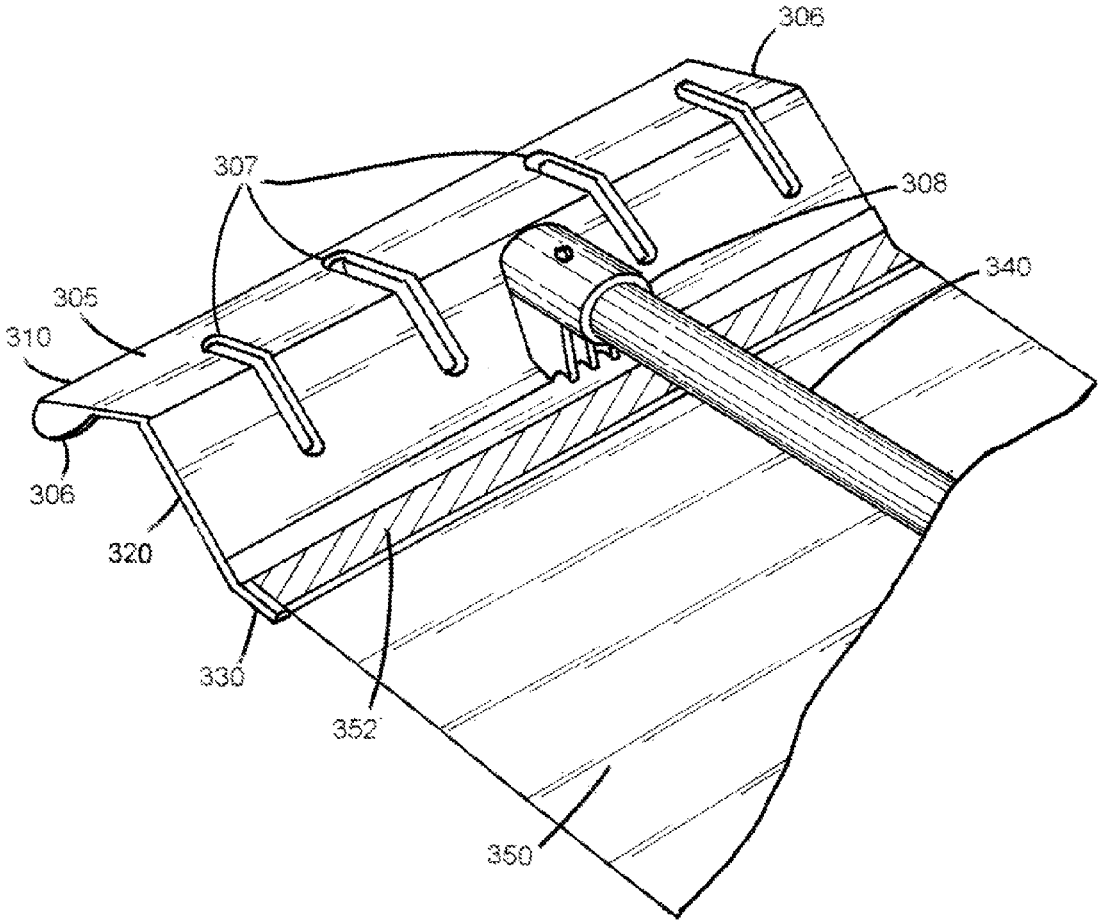
FIG. 6 illustrates an optional embodiment of a snow removal device including optional shingle protection tabs, stiffening ribs, and a removable cylindrical handle, in accordance with the present invention.

FIG. 6 illustrates an optional embodiment of a snow removal device including optional shingle protection tabs, stiffening ribs, and a removable cylindrical handle. Device 305 is illustrated including tool panel portions 310, 320, and 330 which are consistent with portions 10, 20, and 30 of device 5. Stiffening ribs 307 are provided, for example, molded into the plastic material of the surface of portions 310 and 320. Shingle protection tabs are provided, extending downwardly from portion 310 to prevent the front edge of device 305 from accidentally digging under the edge of a roof shingle. Tabs 306 can be curved to allow the tabs to ride upon a surface of the roof shingles without digging into the shingle materials. A round, replaceable handle 340 is illustrated inserted into a handle receiving portion 308 of device 305. Sheet 350 is illustrated attached to portion 330 in attachment region 352, for example, with an adhesive or through vibration welding.

Sheets 50 and 350 are illustrated as pliable plastic sheets. In other exemplary embodiments, portion 30 can simply be extended in a flat section extending parallel with a roof surface, providing an additional length for snow to fall upon and pick up speed before falling from the roof surface.

Advantages of the disclosed device include that the tool can be used without touching the roof surface; the tool can be lighter weight than other designs, making the device more usable for persons with lesser strength; the device has a tendency to undercut the snow as it is pushed forward; the device can be constructed with welded or adhered joints, thereby removing weaknesses associated with mechanical fasteners; and the tool can be used to break large chunks of thick snow easily into smaller chunks which are gravity fed off the roof.

The disclosed tool can benefit from the use of the attached pliable sheet to aid in speeding chunks of snow away from the roof surface. Such a pliable sheet can be used with other snow removal tools, and the disclosure is not intended to be limited to the particular examples provided herein.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A snow removal device for removing snow from a roof surface, the device comprising:

a multi-angled tool comprising a plurality of panels, comprising:

a handle comprising a pole;

a first planar panel portion angled in a first direction in relation to a longitudinal axis of the pole, the angle causing the first planar panel portion to dig into the snow when a user pushes forward on the pole;

a second planar panel portion connected to a trailing edge of the first panel portion, the second panel portion angled in a second direction opposite of the first direction in relation to the longitudinal axis of the pole, wherein the second planar panel portion is connected to the pole and wherein the second angle is non-perpendicular to the longitudinal axis of the pole; and a third panel portion connected to a trailing edge of the second panel portion, the third panel portion being configured to slide over snow compacted by the second panel.

2. The device of claim 1, wherein the third panel portion is angled in a direction parallel to the longitudinal axis of the pole.

3. The device of claim 1, wherein the third panel portion is angled in the second direction, wherein the third panel portion is closer to a direction parallel to the longitudinal axis of the pole than the second planar panel portion.

4. The device of claim 1, wherein a flat sheet is connected to the third panel portion.

5. The device of claim 4, wherein the flat sheet comprises a pliable plastic sheet.

6. The device of claim 5, wherein the flat sheet is attached to the third panel portion with a rod inserted within a wrap around section of the third panel portion.

7. The device of claim 5, wherein the flat sheet is attached to the third panel portion with a plurality of fasteners.

8. The device of claim 5, wherein the flat sheet is attached to the third panel portion with an adhesive.

9. The device of claim 1, wherein the first planar panel portion comprises at least one rounded tab extending in the first direction configured to prevent a front edge of the first planar panel portion from contacting roofing shingles of the roof surface.

10. The device of claim 1, further comprising at least one reinforcement rib spanning across the first planar panel portion and the second planar panel portion.

11. A snow removal device for removing snow from a roof surface, the device comprising:

a handle comprising a pole; and a multi-angled tool comprising a plurality of panels, comprising:

a first planar panel portion angled in a first direction in relation to a longitudinal axis of the pole, the angle causing the first planar panel portion to dig into the snow when a user pushes forward on the pole;

a second planar panel portion connected to a trailing edge of the first panel portion, the second panel portion angled in a second direction opposite of the first direction in relation to the longitudinal axis of the pole, wherein the second planar panel portion is connected to the pole and wherein the second angle is non-perpendicular to the longitudinal axis of the pole; and a third panel portion connected to a trailing edge of the second panel portion, the third panel portion being configured to slide over snow compacted by the second panel; and a flat, pliable sheet connected to the third panel portion.

* * * * *